United States Patent [19]

Kline et al.

[11] Patent Number: 5,010,878

[45] Date of Patent: Apr. 30, 1991

[54] APPARATUS FOR MOBILIZING A PATIENT'S TOES

[76] Inventors: Joel L. Kline, 6854 Maple Leaf Dr., Carlsbad, Calif. 92009; Mindy S. Armstrong, 3910 Lamont #6, San Diego, Calif. 92109

[21] Appl. No.: 399,846

[22] Filed: Aug. 29, 1989

[51] Int. Cl.[5] ..... A61H 1/02

[52] U.S. Cl. ..... 128/25 R; 128/25 B; 128/26

[58] Field of Search ..... 128/25 B, 25 R, 26, 128/80 R, 80 G, 80 H, 81 R, 83, 84 R, 87 R, 89 R, 25 B, 25 R, 26; 272/94, 96

[56] References Cited

U.S. PATENT DOCUMENTS

| | | | |
|---|---|---|---|
| 2,353,129 | 7/1944 | DeMona | 128/26 |
| 3,867,930 | 2/1975 | Brown | 128/83 |
| 3,901,228 | 8/1975 | Brown | 128/80 RX |
| 3,903,878 | 9/1975 | Spann | 128/77 |
| 3,955,565 | 5/1976 | Johnson, Jr. | 128/89 R |
| 4,057,056 | 11/1977 | Payton | 128/83.5 |
| 4,186,738 | 2/1980 | Schleicher et al. | 128/153 |
| 4,289,122 | 9/1981 | Mason et al. | 128/80 |
| 4,446,856 | 5/1984 | Jordan | 128/80 |
| 4,487,199 | 12/1984 | Saringer | 128/25 |
| 4,538,595 | 9/1985 | Hajianpour | 128/25 R |
| 4,558,692 | 12/1985 | Gruner | 128/25 R |
| 4,576,148 | 3/1986 | Koerner et al. | 128/25 RX |
| 4,644,938 | 2/1987 | Yates et al. | 128/25 RX |
| 4,665,899 | 5/1987 | Farris et al. | 128/25 |
| 4,665,900 | 5/1987 | Saringer | 128/26 |
| 4,716,889 | 1/1988 | Saringer | 128/25 |
| 4,795,148 | 1/1989 | Rangaswany | 128/25 BX |
| 4,796,611 | 1/1989 | Wardlaw | 128/87 |
| 4,862,875 | 9/1989 | Heaton | 128/25 B |
| 4,869,499 | 9/1989 | Schiraldo | 272/96 X |
| 4,919,118 | 4/1990 | Morris | 128/80 HX |

FOREIGN PATENT DOCUMENTS

| | | | |
|---|---|---|---|
| 3618686 | 12/1987 | Fed. Rep. of Germany | 128/25 R |
| 457018 | 7/1913 | France | 128/25 R |
| 1325526 | of 1963 | France | 128/83 |

OTHER PUBLICATIONS

John J. Stienstra, D.P.M., Continous Passive Motion—A Podiatric Overview, The Journal of Foot Surgery, vol. 26, No. 1, pp. 41-45, 1987.

*Primary Examiner*—Richard J. Apley
*Assistant Examiner*—Linda C. M. Dvorak
*Attorney, Agent, or Firm*—Nydegger & Associates

[57] ABSTRACT

An apparatus for supporting a patient's foot allows adjustable positioning of a continuous passive motion device for mobilizing the patient's toes. A soft resilient foam base supports the patient's lower leg and foot, and a soft resilient foam cover is attachable thereto for holding the foot in the base. The base includes an abutment for supporting the foot at a base angle with the longitudinal axis of the base of about one hundred twenty degrees. The cover and base have a layer of pile fabric. A plurality of flexible hook straps are detachably positioned along the outer walls of the cover and base for firmly holding the cover securely in position about the lower leg to hold the foot in the fixed position at the base angle of about one hundred twenty degrees. A hook fastener strip is positioned on a top surface of the foam cover. A continuous passive motion device has a pile fastener strip fixedly attached to the bottom thereof for adjustably removably attaching the continuous passive motion to the top of the cover for mobilizing the patient's toes.

12 Claims, 2 Drawing Sheets

APPARATUS FOR MOBILIZING A PATIENT'S TOES

FIELD OF THE INVENTION

This invention relates generally to physical therapy devices for articulating the joints of a human being. More specifically, the invention relates to an apparatus for performing continuous passive motion therapy for a patient. The present invention is particularly, though not exclusively, useful for mobilizing the toes of a patient after surgery.

BACKGROUND OF THE INVENTION

Over the years there have been different methods and apparatus for treatment of injuries to the bones, joints and muscles of a patient. In particular, various forms of physical therapy have been utilized for injury and for rehabilitating various joints following surgery. In approximately 1980, Dr. Robert B. Salter, professor and head of Orthopedic Surgery at the University of Toronto, developed a concept and coined the expression "continuous passive motion", which work is described in the article "Joints Were Meant to Move-and Move Again", by Olendorf in "The Graduate", published by the Department of Information Services, University of Toronto 1980. It has been found that patients who have injured joints heal quicker and better artificially moving the injured joints slowly back and forth. This is in comparison to the joint being held motionless, or being moved intermittently between long intervals. It has been stated that keeping the injured or post-operative body part mobile rather than immobilizing it, such as in a cast, results in improved healing effects.

There are many different types of apparatus available which are designed for supplying continuous passive motion to human joints. For example, Saringer U.S. Pat. No. 4,665,900 discloses an apparatus for applying continuous passive motion to the joints of several fingers of the hand at the same time It uses a saddle of relatively rigid thin plastic mounted on the forearm. The continuous passive motion activating device is attached to the saddle, and is connected to the fingers of the hand for continuously reciprocating the fingers back and forth. Such an apparatus utilizes a rigid, thin plastic saddle attached to the forearm which may become uncomfortable, although it may be conducive to firmly holding a continuous passive motion drive device firmly in place.

In addition, there are a number of other devices for supporting a human limb and its associated extremity. For example, Spann U.S. Pat. No. 3,903,878 discloses a support block of resilient polyurethane foam material. Such devices, however, are for the purpose of restraining limb members, including the lower leg, to cradle the limb. Thus, these devices are for holding the limb to prevent any movement thereof. A device for restraining the heel of a patient is disclosed in Schleicher et al. U.S. Pat. No. 4,186,738 for a heel supporting boot for bed patients. It discloses a heel supporting boot formed of resilient flexible foam material with a plurality of peaks and valleys for supporting the patient's leg above the adjacent bed surface, while it is exposed to the air. Again, this device is for the purpose of supporting the heel in a fixed position and is not conducive to continuous passive motion therapy as contemplated by the present invention.

Thus, the present invention recognizes the need for a device for adjustably positioning a continuous passive motion device on the shin to mobilize the lower limb of a patient, and the patient's toes in particular. The present invention further recognizes that it is important that the foot be held at the proper angle for maximum effective range of motion in connection with therapy, while allowing flexibility for properly mobilizing the toes of the patient as required.

Accordingly, it is an object of the present invention to provide an apparatus for adjustably positioning a continuous passive motion device for mobilizing a patient's toes. It is a further object to also hold the foot of a patient in proper position for allowing adjustable positioning of a continuous passive motion device to mobilize the toes thereof. It is yet another object of the present invention to provide such a device which is portable, lightweight, and comfortable. It is yet another object of the present invention to provide such a device which is adjustable to fit a foot and lower leg of many different size patients. Another object of the present invention is to provide such a device which is simple and efficient to use, and easily manufactured. Another object of the present invention is to provide such an apparatus which may be readily adjusted and which is reliable and durable in its use.

SUMMARY OF THE INVENTION

A preferred embodiment of the apparatus for supporting a patient's foot and adjustably positioning a continuous passive motion device for mobilizing a patient's toes comprises a soft resilient foam base. The base has a concave channel extending along its longitudinal axis for supporting the calf portion of the patient's leg. The base further includes a slanted abutment at one end of the channel. The abutment forms a base angle with the longitudinal axis of the base. Preferably, the angle is greater than ninety degrees (90°), and in the preferred embodiment shown is about one hundred twenty degrees (120°). A cover made of soft resilient foam has a concave channel extending substantially along its longitudinal axis. The cover fits over the base and is engageable with the shin portion of the lower leg. The base and cover each have an outer layer of loop pile fabric. A plurality of hook fasteners are transversely spaced along the outer walls of the base. The cover is detachably fastened to the base securely in position about the lower leg by the hook fasteners engaging the cover and base. The foot is thus securely held in a fixed position at the base angle of about one hundred twenty degrees (120°). A mounting pad is placed on a top surface of the cover for removably adjusting a continuous passive motion device securely in position for mobilizing the patient's toes. A flexible end strap, having hook fasteners at each end thereof, is positionable about the abutment to hold the cover securely in longitudinal position with respect to the abutment.

The novel features of this invention, as well as the invention itself, both as to its structure and its operation, will be best understood from the accompanying drawings, taken in conjunction with the accompanying description, in which similar reference characters refer to similar parts, and in which:

DESCRIPTION OF THE PREFERRED EMBODIMENT

Figure 1:
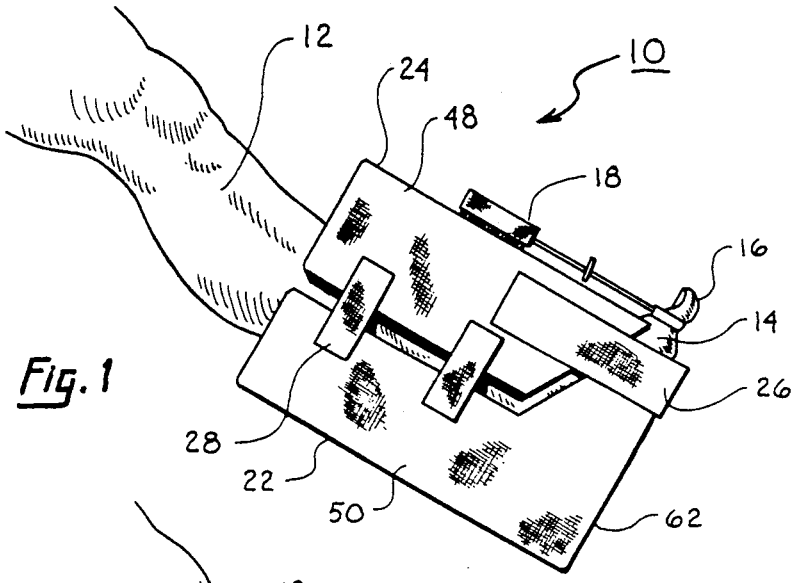
FIG. 1 is a side view of the apparatus for supporting a patient's foot and adjustably positioning a device for mobilizing the patient's toes for use in its intended environment in accordance with the present invention.

FIG. 1 shows the apparatus, generally designated 10, for supporting a patient's foot and adjustably positioning a device for mobilizing a patient's toes in its intended operating environment. Also shown placed within apparatus 10 is a lower leg 12 and foot 14 of a patient. Attached to the toes 16 of patient's foot 14 is a continuous passive motion (CPM) device 18 for continuously and slowly moving toes 16 back and forth in accordance with therapy prescribed by an attending physician, generally in the direction of arrow 20. One or more toes of patient's foot 14 may be attached to CPM device 18 as appropriate for a given therapy situation.

Apparatus 10 comprises a base 22 and cover 24. Base 22 and cover 24 are made of resilient foam material, of a type which is sufficiently porous to allow circulation of air sufficient for comfort of patient's foot 14. The material is light, yet firm enough to maintain the patient's foot 14 in the appropriate position. Also included is end strap 26 as well as transverse side straps 28 as will be more fully explained below.

Figure 2:
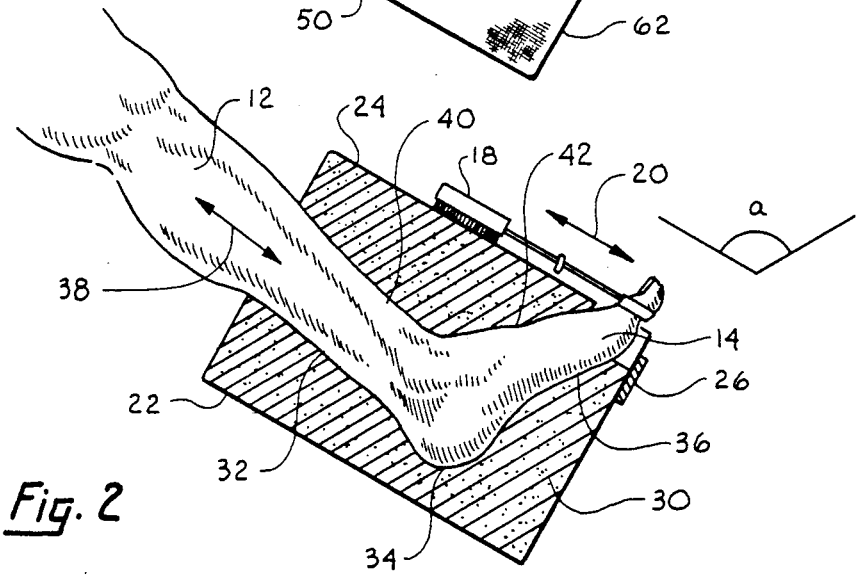
FIG. 2 is a side cross-sectional view of the apparatus shown in FIG. 1.

As shown in FIG. 2, base 22 includes an abutment portion 30 at the distal end thereof. At the junction between abutment 30 and base 22 is a calf supporting portion 32. Also included in base 22 is a heel supporting portion in the form of a concave cavity 34.

It is important to note that abutment 30 has an inclined surface 36 which is engageable with the bottom of patient's foot 14. Inclined surface 36 supports the foot so that the foot 14 generally forms an angle "a" with the longitudinal axis 38 of leg 12. In the preferred embodiment, angle "a" is about one hundred twenty degrees (120°). Patient's foot 14 is held firmly in position at the preferred angle "a" by virtue of the cover 24 engaging the anterior or the shin of patient's leg 12 at shin engaging portion 40 of cover 24. In addition, a tapered portion 42 of cover 24 engages the top of patient's foot 14 for securely holding patient's foot 14 at the preferred angle "a".

Figure 3:
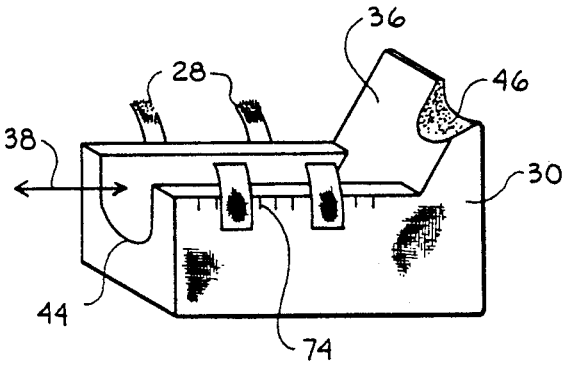
FIG. 3 is a perspective view of a base portion of the apparatus shown in FIG. 1.
Figure 4:
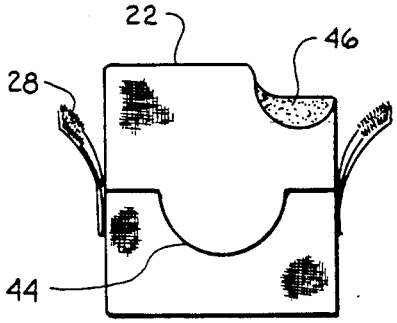
FIG. 4 is an end view of the base shown in FIG. 3.

As further shown with respect to FIGS. 3 and 4, base 22 has a concave channel 44 extending substantially along its longitudinal axis 38 for supporting the posterior or calf portion of patient's leg 12. In addition, concave cavity 34 is correspondingly shaped for allowing the comfortable fit of patient's heel. Abutment 30 has a notched portion 46 at approximately the area which would be engaged by the ball of foot 14 and by the big toe of patient's foot 14. This allows maximum range of motion for the continuous passive motion therapy as will be further described below. In addition, it may readily be seen that the contour of concave channel 44, including concave cavity 34 and inclined surface 36, is such to effectively cradle the patient's lower leg 12 and foot 14 in the apparatus 10.

Base 22 as well as cover 24 are covered with a layer of loop or pile fabric in the preferred embodiment, with cover 24 having a fabric layer 48, and base 22 having a fabric layer 50. This pile fabric is a fabric which is conventionally available under the trade name Velfoam which comprises the pile portion of the typical hook and pile flexible Velcro material fasteners (Velcro is a trademark). Straps 28 comprise the hook strap portion which can then be effectively moved and fastened anywhere onto base 22 and cover 24. This allows cover 24 to be firmly held in position by the plurality of hook straps 28 to base 22 to firmly and securely hold lower leg 12 in position in apparatus 10.

Figure 7:
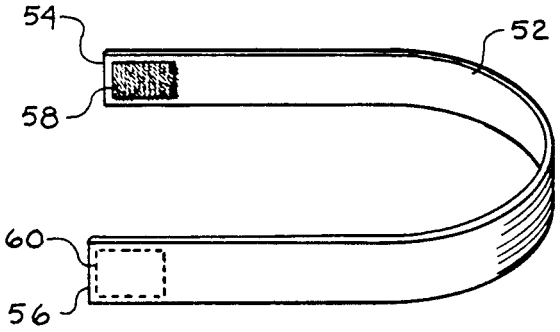
FIG. 7 is a perspective view of an end strap component of the apparatus shown in FIG. 1.

As shown in FIG. 7, a flexible, elastic end strap 26 is also provided. Attached to each end 54, 56 of flexible end strap 26 is a hook fastener pad 58, 60, respectively, preferably also of Velcro hook material. Thus, end strap 26 as shown in FIG. 1, can be strapped around distal end 62 of base 22. Each end 54, 56 may be securely attached to fabric layer 48 on cover 24 to firmly hold the cover securely in longitudinal position on leg 12 with respect to abutment 30. In addition, as further shown in FIG. 2, it may readily be seen that tapered portion 42 of cover 24 pushes against top of foot 14 to hold foot 14 on inclined surface 36 of abutment 30. This holds the foot 14 at the preferred angle "a" for proper therapy in accordance with the present invention.

Figure 5:
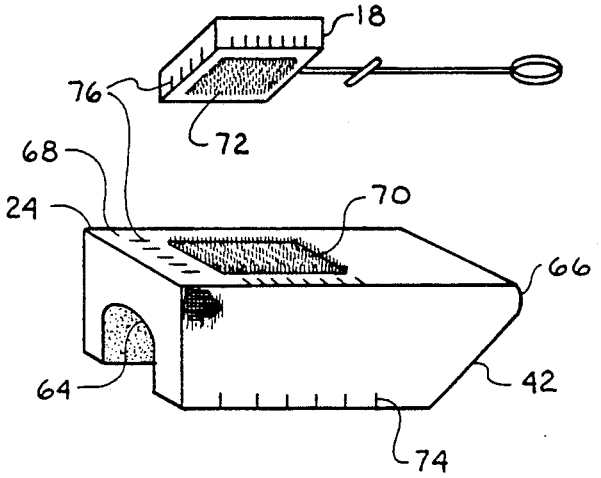
FIG. 5 is a perspective view of a top portion of the apparatus shown in FIG. 1 with a continuous passive motion device to be adjustably positioned thereon.
Figure 6:
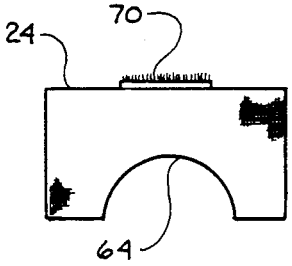
FIG. 6 is an end view of the cover portion of FIG. 5.

Referring now to FIGS. 5 and 6, there is shown in more detail components of cover 24. In particular, foam material cover 24 has a concave channel 64 which extends substantially along its longitudinal axis for the length of cover 24. The concave channel 64 is formed to be engageable with the shin portion of leg 12. In addition, cover 24 includes a shoulder 66 which allows extra movement of toes 16 during therapy and does not interfere with the maximum range of motion desired for effecting the continuous passive motion therapy. Cover 24 has a top surface 68. Mounted on top surface 68 is a hook fastener strip 70. Since cover 24 has a Velfoam loop fabric layer 48 covering it, a double-backed Velcro hook fastener strip 70 effectively holds the hook fastener strip in position on top surface 68. CPM device 18 has fixedly attached on the lower side thereof a loop Velcro fastener strip 72. As may be seen in FIG. 5, since loop fastener strip 72 is fixedly attached to CPM device 18, CPM device 18 may be readily detached and securely repositioned on cover 24, and thus apparatus 10.

In operation, the patient's leg 12 is placed into apparatus 10 and the cover 24 is placed thereon. The plurality of hook straps 28 are placed transversely to securely hold cover 24 on base 22. Foot 14 is thus firmly held against abutment 30 at angle "a". Then, CPM device 18 is mounted in proper longitudinal position on hook fastener strip 70. This places device 18 in proper longitudinal orientation with respect to toes 16. Once the device is set by the attending physician, indicator marks 74 are placed on cover 24 and base 22 to show the patient how to properly place the cover 24 and base 22 about the patient's leg 12. In addition, the attending physician properly places CPM device 18, which also includes indicating marks 76 thereon, for proper longitudinal and horizontal placement thereon for such therapy.

While the particular apparatus for mobilizing a patient's toes as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as defined in the appended claims.

What is claimed is:

1. An apparatus for supporting a patient's foot and adjustably positioning a continuous passive motion device for mobilizing a patient's toes, comprising:

a soft resilient foam base for supporting a patient's lower leg and foot, said base having a concave channel extending substantially along a longitudinal axis of said base for supporting the posterior portion of said lower leg, said base further having a slanted abutment at one end of said channel having a depression for supporting the heel, said abutment forming a base angle with said longitudinal axis of about one hundred twenty degrees;

a soft resilient foam cover having a top surface and a concave channel extending substantially along a longitudinal axis of said cover, said cover being engageable with the anterior portion of said lower leg;

means for detachably fastening said cover to said base securely in position about said lower leg to hold said foot in a fixed position at said base angle of about one hundred twenty degrees;

means mounted on said top surface for removably adjustably attaching said continuous passive motion device securely in position for anterior topical placement of the device for mobilizing the patient's toes;

a continuous passive motion device having means for removably attaching said device to said cover; and marking means for indicating longitudinal positioning of said continuous passive motion device on said top surface.

2. An apparatus for supporting a patient's foot as recited in claim 1, wherein said means for detachably fastening said cover to said base comprises said base and cover having an outer layer of pile fabric and a plurality of flexible hook fastener straps transversely spaced along outer walls of said base.

3. An apparatus for supporting a patient's foot as recited in claim 2, further comprising an end strap having hook fasteners at the end thereof engageable with said pile fabric, said strap being positionable about said abutment for holding said cover securely in longitudinal position with respect to said abutment.

4. An apparatus for supporting a patient's foot as recited in claim 2, wherein said concave channel in said base has the same cross-sectional shape as said concave channel in said cover.

5. An apparatus for supporting a patient's foot as recited in claim 1, wherein said cover and base include marking means for indicating longitudinal positioning of said cover with respect to said longitudinal axis of said base.

6. An apparatus for supporting a patient's foot as recited in claim 2, further comprising a continuous passive motion device having hook fasteners attached to a bottom side thereof, and wherein said mounting means comprises said top surface of said cover having a layer of pile fabric.

7. An apparatus for holding a patient's foot in a desired position while mobilizing the patient's toes with a continuous passive motion device, comprising:

a soft resilient base having a channel and an abutment for supporting a patient's foot at an angle of about one hundred twenty degrees with the longitudinal axis of the patient's leg;

a soft resilient cover;

means for detachably fastening said cover to said base for holding said patient's foot at said angle;

a continuous passive motion device having means for detachably coupling said device to said cover; and marking means for indicating longitudinal positioning of said continuous passive motion device on said cover.

8. An apparatus for supporting a patient's foot as recited in claim 7, wherein said means for detachably fastening said cover to said base comprises said base and cover having an outer layer of pile fabric and a plurality of flexible hook fastener straps transversely spaced along outer walls of said base.

9. An apparatus for supporting a patient's foot as recited in claim 8, further comprising an end strap having hook fasteners at the end thereof engageable with said pile fabric, said strap being positionable about said abutment for holding said cover securely in longitudinal position with respect to said abutment.

10. An apparatus for supporting a patient's foot as recited in claim 8, wherein said concave channel in said base has the same cross-sectional shape as said concave channel in said cover.

11. An apparatus for supporting a patient's foot as recited in claim 7, wherein said cover and base include marking means for indicating longitudinal positioning of said cover with respect to said longitudinal axis of said base.

12. An apparatus for holding a patient's foot as recited in claim 7, wherein said abutment includes a notched portion.

* * * * *